United States Patent [19]

Hatlapa et al.

[11] 4,169,580

[45] Oct. 2, 1979

[54] HYDRAULIC WINCH FOR SHIPBOARD USE

[75] Inventors: Rolf Hatlapa, Uetersen; Bernd Horn, Hamburg, both of Fed. Rep. of Germany

[73] Assignee: Hatlapa Uetersener Maschinenfabrik GmbH, Uetersen, Fed. Rep. of Germany

[21] Appl. No.: 851,970

[22] Filed: Nov. 16, 1977

[30] Foreign Application Priority Data

Nov. 23, 1976 [DE] Fed. Rep. of Germany ..... 2653102

[51] Int. Cl.[2] ..... B66D 3/22

[52] U.S. Cl. ..... 254/186 R; 60/DIG. 10; 60/458

[58] Field of Search ..... 254/186 R, 187 A, 187 B, 254/187 C, 187 E, 187 G, 187 R, 150 R; 60/400, 435, 458, DIG. 10

[56] References Cited

FOREIGN PATENT DOCUMENTS 947018 7/1949 Fed. Rep. of Germany .

1250991 9/1967 Fed. Rep. of Germany .

*Primary Examiner*—Robert J. Spar

*Assistant Examiner*—Jerold M. Forsberg

*Attorney, Agent, or Firm*—Michael J. Striker

[57] ABSTRACT

An electrically powered hydraulic winch has a main support containing a transmission connected on one side to a winch drum and connected on its other side to the output shaft of a hydraulic motor contained in a drive housing releasably bolted to the side of the support. A motor housing is fixed to the bottom of the drive housing and forms a fluidtight compartment containing a drive unit formed of an electric motor and a hydraulic pump, which latter is connected via a control unit in the drive housing to the hydraulic motor. A reservoir in the drive housing above the compartment maintains this compartment completely full of hydraulic fluid that is also used in the drive circuit between the hydraulic pump and motor.

11 Claims, 5 Drawing Figures

HYDRAULIC WINCH FOR SHIPBOARD USE

BACKGROUND OF THE INVENTION

This invention relates to a hydraulic winch, particularly a winch for ships, the winch having an upright housing, at least one cable drum, a hydraulic motor driving a mechanical gear unit or transmission in turn driving the cable drum, a hydraulic pump driven by an electric motor as well as a controller for both the hydraulic pump and the hydraulic motor.

Among the conventional hydraulic winches are those having the mechanical gear transmission accommodated in a gear support unit which is fastened to the support housing and which extends into the cable drum coaxial to the hydraulic gear arranged in the support housing, while the electric motor driving the hydraulic pump is fixed coaxially to the cable drum at the side of the support housing which is turned away from the cable drum. This kind of conventional winch is space-consuming. It requires a relatively large space for the winch drive and a complete adaption of the mechanical gear transmission and the cable drum arrangement to the hydraulic drive apparatus.

A more compact hydraulically driven winch is known. It has an electric motor and a hydraulic pump arranged in a common housing. This common housing is located directly under the hydraulic motor and the cable drum and serves as a base for the winch. The electric motor can be wet-running and can be arranged in the hydraulic fluid reservoir of the hydraulic pump. The cable drum is directly driven by the hydraulic motor without an interposed mechanical gear transmission. However, this conventional winch still requires a complete adaption in the arrangement and mounting of the cable drum to the hydraulic drive apparatus.

Finally, various directly electrically driven winches are well known. In these winches, the mechanical gear transmission located in an upright housing is directly connected to the drive shaft of an electric motor arranged at one side of the upright housing. The electric motor is located in a substantially cylindrical housing which is fastened to the supporting housing. A box-like ventilator housing is provided under the electric motor. The ventilator housing contains a fan driven by a fan motor and rotating about an axis parallel to the axis of the electric motor. The disadvantage of these winches is that the motor output is not effectively used over a range of varying loads.

SUMMARY OF THE INVENTION

An object of the invention is to provide an improved winch having a maximally compact construction in which it is not necessary to specially adapt the mechanical parts of the winch.

Another object of the invention is to provide a hydraulic winch in which the hydraulic apparatus can be quickly and simply exchanged for an electric drive.

These objects are attained according to this invention in a winch having a stationary support housing normally fixed to the ship deck and itself containing a mechanical gear-type transmission having an input and an output carrying at least one winch drum or capstan. A drive housing is releasably secured to the side of the support and itself contains a hydraulic motor whose output shaft is connected to the transmission input. A motor housing is secured to the bottom of the drive housing and forms a fluid-tight compartment containing a drive unit formed by a wet-running electric motor and a hydraulic pump connected mechanicaly to the electric motor and hydraulically to the hydraulic motor. A reservoir in the drive housing is connected, as for example by a hydraulic pipe or line, to the compartment so as gravitationally to maintain it completely full of hydraulic fluid and thereby completely surround the electric motor and hydraulic pump with this fluid.

The mechanical part of the inventive winch comprises the support housing, the mechanical gear transmission and the cable drum. This mechanical part of the winch can be driven by either the inventive hydraulic drive or by an electric motor. Either way, the mechanical part of the winch need not be altered. Even in previously installed winches, the inventive hydraulic drive can be quickly and easily exchanged for an electric motor or vice versa. For this reason, considerable economy is attained both in the manufacture and assembly of the winch. The inventive winch has a particularly space-saving, compact design and mounting for the hydraulic drive. An important feature is that the drive housing is detachably flanged to the side of the support housing in which the mechanical part of the winch is supported. The advantage of this feature is the easy access which this design permits; therefore, installation, construction and repair work is greatly facilitated. Lack of adequate access causes great difficulty when the drive apparatus is located under a floor or a ship's deck.

In accordance with the inventive concept, the electric motor driving the hydraulic pump is arranged inside the hydraulic fluid compartment in such a manner as to be explosion-proof. Due to the hydrostatic drive the moment of rotation and the lifting power with constant output can be regulated over a rather wide range, just as with normal alternating-current electric winches.

The fan, the fan motor and the closable ventilator opening extending through a ventilator cover can all be arranged at about the same height next to the hydraulic motor in the drive housing. Such arrangement permits a particularly effective ventilation and removal of heat from the hydraulic motor. To achieve a particularly compact form, the valves, conduits and other controllers of the oil flow as well as the oil filter may be arranged in a very space-saving manner in which all of the components of the drive apparatus are fixed with their auxiliary devices to a narrow portion of the support housing and are outwardly surrounded by the drive housing. With such an embodiment, the drive can be regulated and actuated by electrical switches remote from the winch.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF A PREFERRED EMBODIMENT

Figure 1:
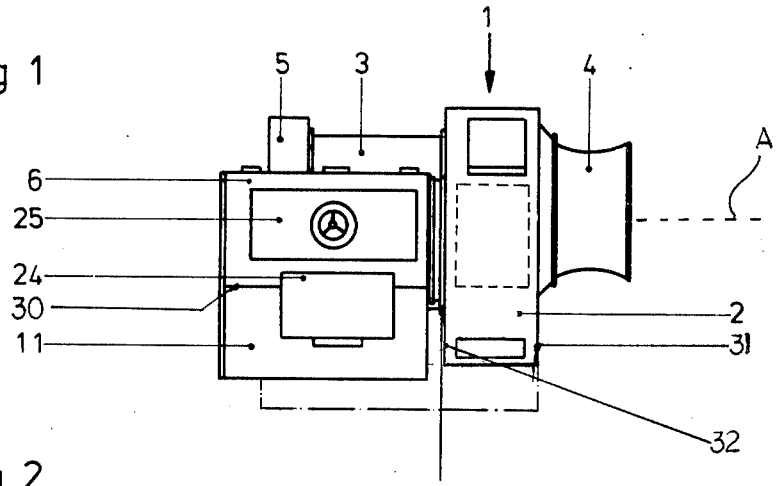
FIG. 1 is a side view of the inventive winch.
Figure 2:
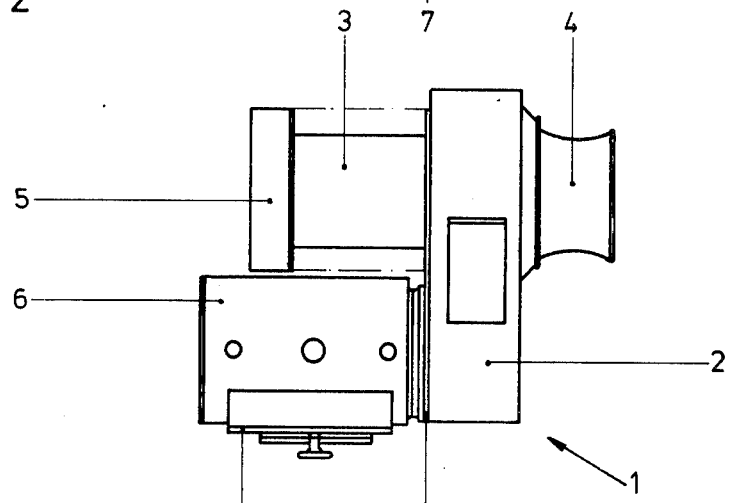
FIG. 2 is a top view of the winch of FIG. 1.
Figure 3:
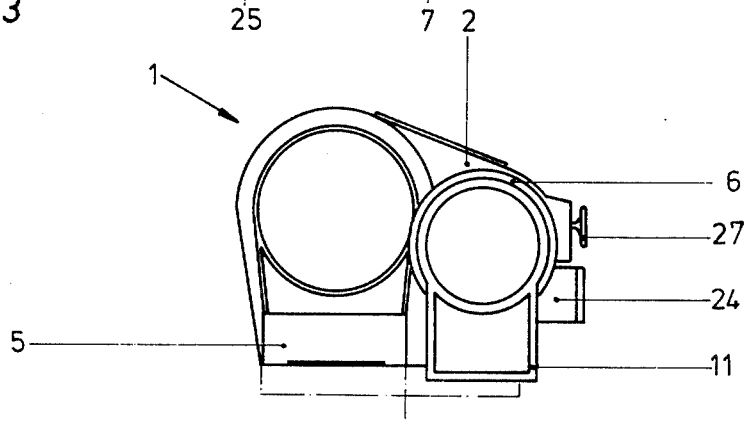
FIG. 3 is an end view of the winch of FIG. 1.

The winch illustrated in FIGS. 1–3 is mounted on the deck of a ship and, more particularly, on a base shown in dot-dash lines. An upright support housing 2 is fixed to this base. This upright housing 2 supports a cable drum 3 and a rotatably mounted capstan 4. The cable drum 3 has two spaced ends, one of which is journalled on a mounting block 5 and the other of which is mounted on the upright housing 2 near a side wall 32 thereof. The winch drum 4 projects from the opposite side wall 31 of the upright housing 2. Cable drum 3 and winch drum 4 are jointly rotatable about an axis A which is substantially horizontal relative to the base and substantially perpendicular to the side walls 31 and 32 of the upright housing 2. A mechanical gear transmission is located in the upright housing 2. Such transmission is known per se in the art and for this reason is shown only schematically in dot-dash lines.

Figure 4:
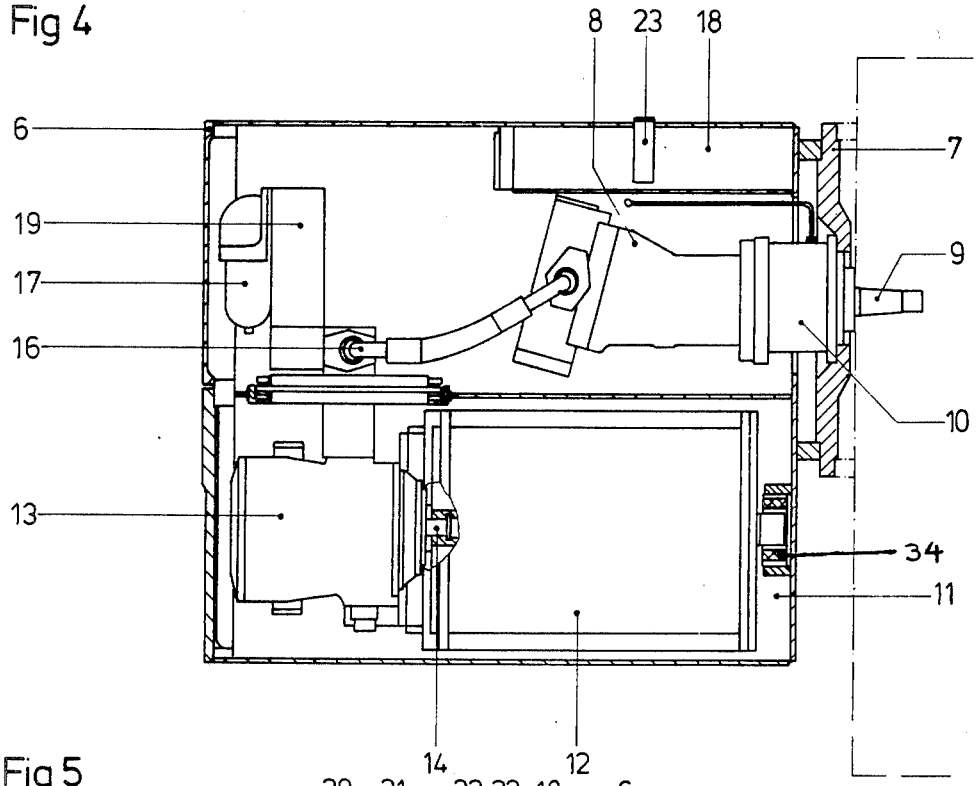
FIG. 4 is a vertical section through the hydraulic drive fastened to the upright support.
Figure 5:
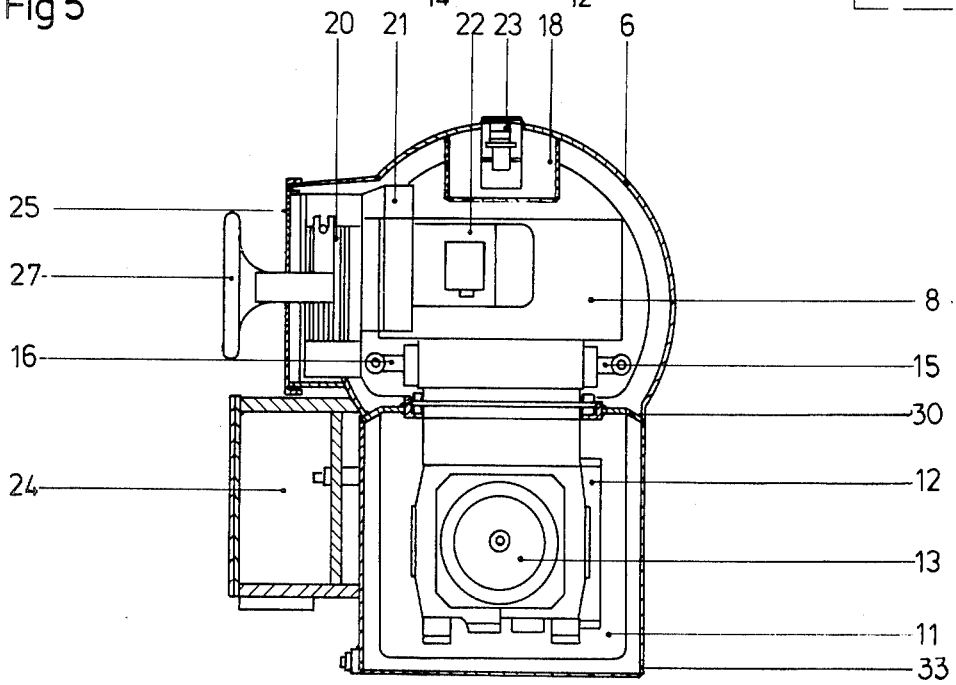
FIG. 5 is another vertical section through the hydraulic drive of FIG. 4.

A drive housing 6 is provided with a flange 7 secured to the side 32 of the upright housing 2. This housing 6 whose upper wall is part cylindrical, has a ventilator cover 25, opened and closed by turning a hand wheel 27. Also, the drive housing 6 includes a connection box 24 for electrical connections. As shown in both FIGS. 4 and 5, the drive housing 6 contains an axial-piston hydraulic motor 8 which is connected to a brake 10, shown as being only partially within the drive unit 6. The brake 10 is connected to the flange 7. Extending past brake 10 and projecting through flange 7 is the output shaft 9 of the hydraulic motor 8. The output shaft 9 of the hydraulic motor 8 is connected with an input shaft of the mechanical gear transmission whose output shaft, in turn, is connected to the cable drum. The drive unit 6 also contains a fluid reservoir 18, a hydraulic fluid or oil cooler 20 and a fan 21 driven by a motor 22. The fluid reservoir 18 may act as an overflow area, for a fluid-filled compartment 11. The oil cooler 20 is connected to conduits feeding oil or hydraulic fluid into the hydraulic motor 8. Suspended directly below the drive unit and also laterally positioned relative to side 32 of the upright housing 2, is a motor housing 33 defining the compartment 11. The hydraulic fluid compartment 11 is separated from the drive unit 6 by a partition 30. An electric motor 12 and a hydraulic pump 13 are arranged inside the hydraulic fluid reservoir 11. The electric motor 12 is constructed that it can operate while being immersed in hydraulic fluid. A drive shaft 14 connects the output end of the electric motor with the hydraulic pump 13. The hydraulic pump 13 is connected to the hydraulic motor 8 in the drive unit 6 by way of a pressure conduit 15 and return conduit 16. The hydraulic fluid passes through these conduits 15 and 16.

The flow of oil through conduits 15 and 16 is regulated by a controller, which is located in the drive housing. An oil or hydraulic fluid filter 17 is connected to at least one of the conduits 15 and 16 in order to remove impurities from the hydraulic fluid contained therein. The fluid reservoir 18 is provided with filter opening 23. The hydraulic pump 13 and the electric motor 12 are suspended in the hydraulic fluid compartment 11 from a common rubber insulated block 34.

In order to control the amount of hydraulic fluid addition, an unillustrated level controlling apparatus may be provided.

The pressure of the air cushion in the fluid reservoir 18 is regulated by a spring-loaded check valve. The provision of this check valve makes it possible to admit air into the fluid reservoir 18 and prevent hydraulic fluid from leaking out the filter opening 23.

The temperature of the hydraulic fluid is maintained within a predetermined range by the fan 21 which is driven by the motor 22. The output of motor 22 can be controlled by a thermostat. The regulation of the winch takes place automatically on one hand by way of a control lever and on the other hand by way of an appropriate manual activation of a remote electrical control mechanism connected to the connection box 24. The hydraulic fluid flow of the hydraulic pump 13 and the amount of slip of the adjustable hydraulic motor 8 is controlled by the control means 19.

It will be understood that each of the elements described above, or two or more together, may also find a useful application in other types of constructions differing from the types described above.

While the invention has been illustrated and described as embodied in a hydraulic winch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic winch comprising a stationary support housing; a cable drum rotatably supported by said support housing; a mechanical gear transmission disposed in said support housing and having an input shaft and an output shaft connected to said cable drum; a drive housing; a hydraulic motor in said drive housing and having an output shaft connected to said input shaft of said mechanical gear transmission; a hydraulic fluid housing defining a substantially closed hydraulic fluid compartment; a wet-running electric motor in said hydraulic fluid compartment and having an output shaft; a hydraulic pump in said hydraulic fluid compartment and connected to said output shaft of said electric motor; and hydraulic fluid conduits connecting said hydraulic pump to said hydraulic motor, so that said electric motor can drive said hydraulic motor through said hydraulic pump, said stationary support housing supporting said cable drum and accommodating said mechanical gear transmission being upright and having two side walls which are spaced from one another in a horizontal direction, said drive housing accommodating said hydraulic motor being separate from and secured laterally suspended to one of said side walls of said upright support housing, said hydraulic fluid housing accommodating said electric motor and hydraulic pump being also located laterally of said one side wall of said upright supporting housing and secured to the underside of said drive housing to form with the same a unit which can be removed from said support housing and replaced with an electric motor when it is desired to drive said input shaft of said gear transmission electrically rather than hydraulically.

2. The winch defined in claim 1, further comprising control means in said drive housing for varying the output speed of said hydraulic motor without changing the operation speed of said pump, and an oil cooler connected between said pump, hydraulic motor, reservoir, and compartment.

3. The winch defined in claim 1, wherein said output shaft of said hydraulic motor projects from said drive housing in said stationary support housing, said drive housing having an upright flange surrounding said output shaft said flange being secured to the upper side wall of said support housing and said drive housing being separated by a partition from said hydraulic fluid compartment.

4. The winch defined in claim 3, further comprising a brake in said drive housing between said hydraulic motor and said transmission.

5. The winch defined in claim 3, further comprising ventilating means including a ventilating motor and a fan mounted thereon in said drive housing.

6. The winch defined in claim 5, wherein said drive housing has a removable cover over said fan.

7. The winch defined in claim 3, further comprising an oil filter in said drive housing, connected between said hydraulic pump and motor.

8. The winch defined in claim 3, further comprising means for regulating the flow of fluid between said pump and said hydraulic motor in said drive housing.

9. The winch defined in claim 8, wherein said electric motor is arranged underneath said hydraulic motor and said means for regulating is arranged over said hydraulic pump.

10. The winch defined in claim 3, wherein said drive housing has a part cylindrical upper wall.

11. The winch defined in claim 1, and further comprising means including a hydraulic fluid reservoir in said drive housing above said hydraulic fluid compartment and connected thereto for maintaining same filled with hydraulic fluid.

* * * * *